United States Patent [19]

Piccard

[11] Patent Number: 4,953,706

[45] Date of Patent: Sep. 4, 1990

[54] MECHANICAL OIL CAN SEAL BREAKER

[76] Inventor: Don Piccard, 1445 East River Rd., Minneapolis, Minn. 55414

[21] Appl. No.: 437,756

[22] Filed: Nov. 17, 1989

[51] Int. Cl.[5] ..... B65D 3/26

[52] U.S. Cl. ..... 206/603; 206/601; 222/81; 222/83; 220/277

[58] Field of Search ..... 206/601, 603, 222; 220/277, 284; 215/257, 247, 249, 302; 222/81, 83, 87

[56] References Cited

U.S. PATENT DOCUMENTS

| | | | |
|---|---|---|---|
| 2,063,525 | 12/1936 | Schickel | 222/83 |
| 2,911,129 | 11/1959 | Dienner | 222/83 |
| 3,276,632 | 10/1966 | Stanzel | 222/83 |
| 3,397,820 | 8/1968 | Smith | 222/83 |
| 3,730,336 | 5/1973 | Feldman | 206/603 |
| 4,103,772 | 8/1978 | Wiegner | 206/222 |
| 4,657,159 | 4/1987 | Grant | 222/83 |
| 4,836,370 | 6/1989 | Bosshard | 206/222 |

*Primary Examiner*—David T. Fidei

*Attorney, Agent, or Firm*—Haugen and Nikolai

[57] ABSTRACT

A container opening device for use in combination with a conventional container having a bottom wall flexible walls a extending from said bottom wall to an upper opening, and a closure cap threadably engaged about the container opening. A closure film or seal member is provided to form a secondary seal about the periphery of the opening. A seal perforation blade is carried on an angular rod which is loaded internally of the container, and wherein the user, by pressing the walls of the container inwardly, causes the seal perforation blade and rod to extend outwardly and puncture the secondary seal, thereby making it possible to remove the contents on a safe, expedient basis, and normally without making physical contact with the contents. Preferably, angular rod carrying the the seal perforation blade includes a pair of rod members pivotally joined together at an apex, with the angular relationship changing upon inward deflection of the container walls so that one of the rod members will move outwardly of the container and thus permit a blade or the like to perforate the secondary seal.

2 Claims, 2 Drawing Sheets

MECHANICAL OIL CAN SEAL BREAKER

BACKGROUND OF THE INVENTION

The present invention relates generally to a container opening device and apparatus for use in combination with a conventional container having flexible walls, and further having a closure cap threadably engaged about the container opening, and further having a closure film or seal member forming a secondary seal about the opening. Containers of this type are in wide use, and are employed on a substantial basis as containers for motor oil utilized by internal combustion engines such as automobile engines and the like.

Flexible-walled containers, such as containers fabricated from polyethylene, polypropylene, or the like are in wide usage for retaining and dispensing a variety of fluids. One very common use of such containers is for retention of crankcase motor oil utilized by motorists for four-cycle internal combustion engines. These containers are normally in a generally cylindrical configuration with a bottom wall, a circular spout-like top, and with a closure cap adapted to be threadably engaged about the top. A generally planar annular seal surface is provided about the opening, and a closure film is frequently employed to provide a secondary seal of the container contents with the seal being made about the annular seal surface surrounding the opening. The inner surface of the secondary seal is normally adhesively bonded to the annular surface, and frequently is difficult to perforate and/or remove for pouring of the contents. Such closure films forming secondary seals are commonly employed, and utilized to reduce spillage of the contents, whenever such spillage may lead to the creation of hazardous situations or unusual difficulties in shipment.

In the automotive parts and supply business, it has become common for motorists to purchase containers of motor oil at retail, and maintain proper crankcase oil levels by periodic additions of oil. The advent of self-service retail gasoline outlets has created a still further demand for such products. While in the past it was customary for gasoline outlets to provide full service for their customers, this practice has diminished substantially in recent years, thereby making it necessary now for individual motorists to maintain service and inspection of their vehicles. This includes the periodic addition of motor oil.

In order to appropriately ship containers containing such oils and fluids, and in order to reduce and minimize the spillage of the contents during shipping and handling, and in order to provide an additional guarantee of product security, it is common to employ both a threaded closure cap, along with a closure film to form a secondary seal around the opening. These seals frequently present problems for the user, inasmuch as they are necessarily tough, durable and resistant to tear, in order to fulfill their intended functions in use. Also, it may become necessary for motorists to periodically add such fluids at times when tools and other items are not readily at hand, thereby making the task somewhat cumbersome and unpleasant.

In accordance with the present invention, a seal perforation means is provided which may be loaded internally of the container, and wherein the user presses the walls of the container inwardly, and thereby causes the seal perforation means to extend and puncture the seal, thereby making it possible to remove the contents on a safe and expedient basis. Generally, the seal perforation means of the present invention comprises a pair of elongated rod members pivotally joined together at an apex. The normal disposition is such that the angular relationship of the elongated rod members will change upon inward deflection of the container walls, so that one of the rod members will move outwardly of the container, and thus pass thorough the closure film, and internally rupture the seal. The rod member which is adapted to move upon inward deflection of the container walls is provided with a cutter blade or surface at the free tip thereof, so that the cutter blade may move through the seal film and sever the film to interrupt the integrity thereof, and to permit ready emptying of the contents. Inasmuch as the closure film is adhesively bonded to the surface of the annular seal surface, the seal remains attached to the container and does not enter the environs of the engine. The apparatus of the present invention makes it possible for a user to take a filled container, invert the same, and by gripping the sides, force the cutter blade to move outwardly of the seal film and sever the film following inversion of the container.

Therefore, it is a primary object of the invention to provide an improved means for rupturing container seals on containers having flexible walls or panels, and wherein the device of the present invention is provided with means to perforate the closure film forming a secondary seal with the container so as to permit emptying of the contents.

It is yet a further object of the present invention to provide an improved means for perforating container seals, wherein means, in the form of rod members pivotally joined together at an apex may provide motion to one of the rod members, so as to move such rod member outwardly of the container, and thus perforate the closure film forming the seal for the container.

Other and further objects of the present invention become apparent to those skilled in the art upon a study of the following specification, pendant claims, and accompanying drawings.

DESCRIPTION OF THE PREFERRED EMBODIMENT

Figure 1:
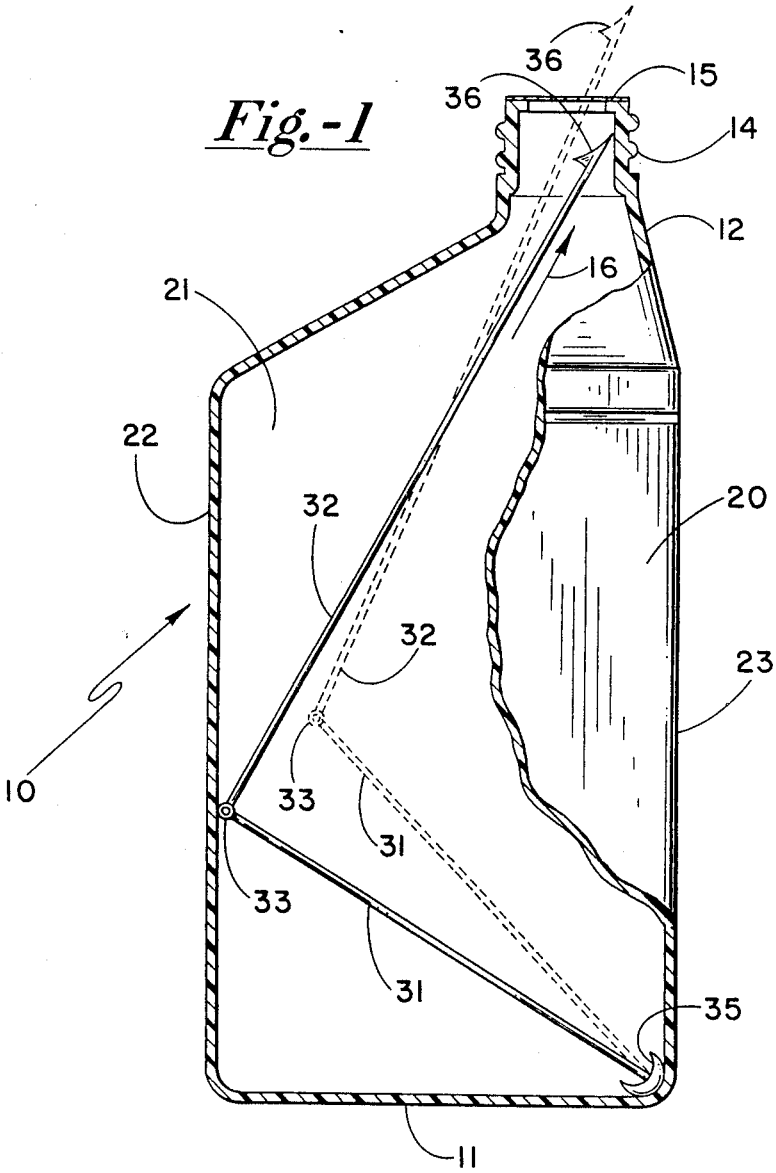
FIG. 1 is a front elevational view of the typical commercially available container with one of the wall panels being cut away so as to illustrate the interior of the container being provided with a closure film perforating device in accordance with the present invention.

In accordance with the preferred embodiment of the present invention, and with particular attention being directed to FIG. 1 of the drawings, the container generally designated 10 has a generally circular configuration with a bottom wall 11, a circular spout-like top 12 with a closure cap 13 adapted to be threadably engaged about the top. Specifically, the threaded engagement is provided by means of threads 14 formed about the periphery of the spout, and with the closure cap being provided with internal mating threads. An annular seal surface is provided as at 15, with the annular seal surface being planar and arranged around the entire circumference of the container discharge opening, with the flow of the contents of the container passing through the opening along the line and in the direction of arrow 16.

Figure 1A:
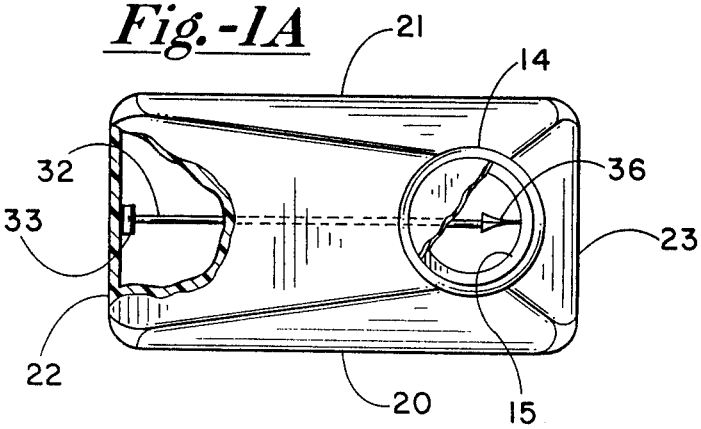
FIG. 1A is a top plan view of the container illustrated in FIG. 1, with portions being cut away to illustrate the interior of the container and the closure film.

The term "cylindrical" is utilized in a comprehensive sense, and is intended to define containers having round or circular walls, as well as those with planar panels, and thus of a generally rectangular cylindrical configuration. Accordingly, container 10 is illustrated and includes flexible side panels including a front panel 20, a rear panel 21, and panels 22 and 23. The panels 20–23 inclusive depend from the spout-like top area 12 and join with the bottom wall 11. A closure film 25 is shown in FIG. 1A, as being bonded to the surface of annular seal surface 15, with such closure films being commonly employed in commerce.

Attention is now directed to the detail of the seal film perforation means illustrated specifically in FIG. 1 of the drawings. The seal film perforation means generally designated 30 comprises a first elongated rod member 31, and a second elongated rod member 32, with rod numbers 31 and 32 being pivotally joined together at their mutual ends 33 to form an apex. The seal film perforation means is, of course, disposed within the container and as indicated in FIG. 1 the rod members 31 and 32 are arranged in generally right angular relationship, one to the other. While the system of the present invention illustrates a pair of elongated rods, it will be appreciative that the "first and second elongated rod members" may be fabricated from a single length of rod, which is hinged after being compressed into place. Actuation occurs after inversion of the container, with means being provided to prevent the rod from falling outwardly of the container.

Attention should now be directed to rod member 31, the component is provided with an anvil means 35 at the free end thereof, with the anvil 35 being normally disposed at the juncture between one of the end panels (such as in panel 23) and the bottom closure wall 11. The second rod member 32 is provided with a cutter blade 36 at the free tip end thereof, and with the cutter blade being normally disposed along an adjacent interior of the spout-like tip 12. Further, blade means 36 is arranged adjacent the inner surface of closure or seal film 25.

As indicated in FIG. 1, the arrangement is such that upon the application of inwardly directed pressure to the end panels 22 and 23, sufficient deflection occurs within the container so as to alter the angular relationship between the first and second elongated rod members 31 and 32. Upon such change, the angular relationship at apex 33 increases so as to cause outward movement of second rod member 32 to force cutter blade 36 to more outwardly of the spout, and in doing so cause perforation of the closure film 25. In the event the device of the present invention is utilized in combination with a round cylindrical container, then, and in that instance, a plurality of legs will be utilized, such as a number of three or more, in order that the location at which pressure is applied is not critical. The utilization of multiple legs will, of course, render the device responsive regardless of the direction of application of force or pressure.

DESCRIPTION OF FIRST ALTERNATE PREFERRED EMBODIMENT

Figure 2:
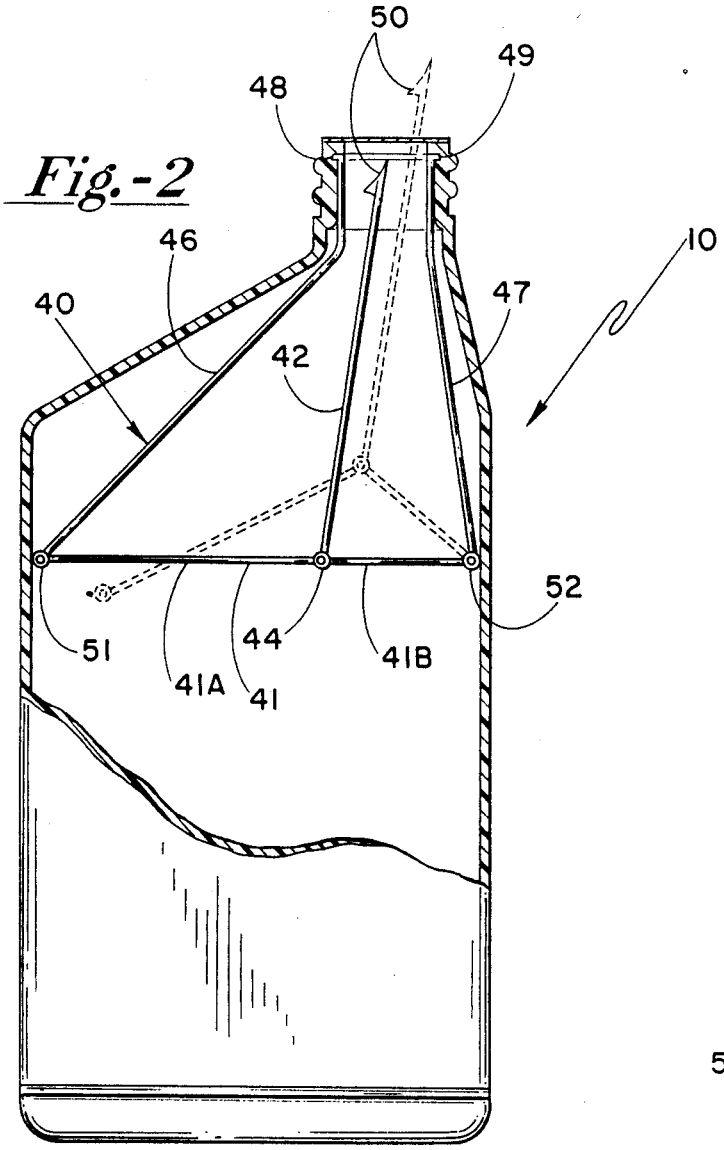
FIG. 2 is similar to FIG. 1, in illustrating a somewhat modified form of seal perforation device internally of the container.

Attention now being directed to FIG. 2 of the drawings, where there will be observed that the container 10, which is similar to that of FIG. 1, is provided with a somewhat modified form of seal film perforation means. This means generally designated 40 comprises a first segmented arm or rod member 41, along with a second elongated rod member as at 42. Rod number 41 is segmented and comprises a pair of segments 41A and 41B, which are joined together at a hinged apex 44. Hinged apex 44 is the point common to a juncture between rods 41A, 41B, and rod 42. Tension members are provided as at 46 and 47, with tension members 46 and 47 being, in turn, secured to the interior of the container by outwardly disposed hook members 48 and 49, respectively. Rod member 42 is provided with a blade or cutter element 50 at the outer free tip thereof.

The juncture points between tension members 46 and 47 with the respective segments of arm 41 are hinged, as at 51 and 52, respectively. Also, the juncture between segments 41A and 41B of rod 41 is hinged, as at 44 to permit deflection of the rod member 42 outwardly of the container.

In operation, the arrangement in FIG. 2 is such that upon the application of inwardly directed pressure sufficient to deflect panels inwardly, the angular relationship between the first and second elongated rod members 41 and 42 is altered, so that the angular relationship at apex 44 increases so as to cause outward movement of rod number 42 to force the cutter blade 50 to move outwardly at the spout and perforate the closure film 25.

In order to assure upward directional motion of blade 50, the angular disposition between segments 41A and 41B must be such that the apex point 44 presents an angle of greater than 180 degrees when viewed from the top, and less than 180 degrees when viewed from the bottom. Such an arrangement will, of course, ensure upward directional motion of blade 50.

Figure 3:
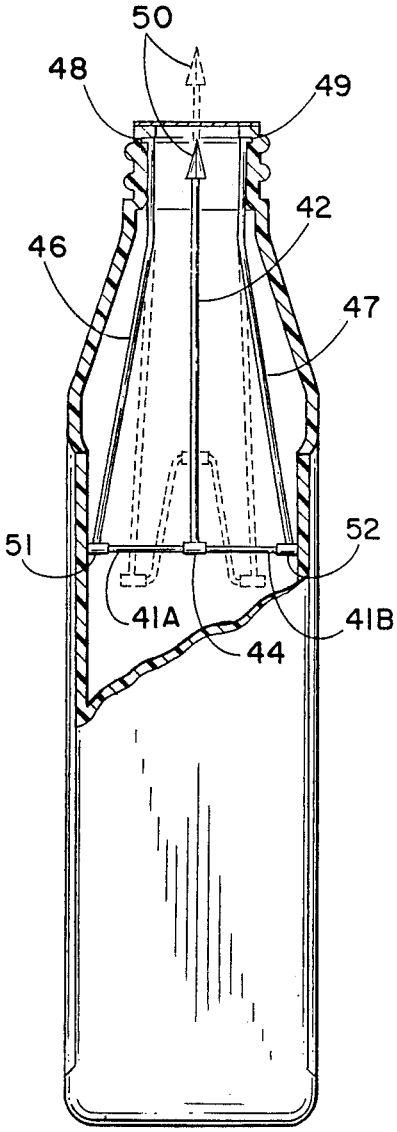
FIG. 3 is similar to FIG. 1, in illustrating a still further embodiment of the present invention.

The materials of construction for the rod members illustrated in this embodiment as well as in the embodiments of FIGS. 1 and 3, is preferably polystyrene or molded polyethylene, or other synthetic resinous film which is most durable, workable and inert to the contents of the container.

The disposition of the seal film perforation means 40 upon deflection of the container walls is illustrated in phantom in FIG. 2 with this arrangement being similar to the phantom illustration of FIG. 1.

DESCRIPTION OF SECOND ALTERNATE PREFERRED EMBODIMENT

Attention is now directed to FIG. 3 of the drawings wherein a second alternate embodiment is illustrated. In this arrangement, the container 10 is provided with a seal film perforation means generally designated 60, and comprises the first segmented elongated rod element 61, formed of segments 61A and 61B, along with second elongated rod number 62. The end 63 of rod 62 is designated as an anvil surface, and joins segments 61A and 61B at their mutual juncture point. Rod members 61 and 62 are accordingly pivotally joined together at apex formed at 63. Lateral tension members 64 and 65 are provided, which in turn grip the container at outwardly turned ends 66 and 67, respectively. As an alternate to the outwardly turned portion 66 and 67, an internal ledge may be formed within the container, if desired, with the internal ledge supporting the base of the seal film perforation means as at points 68 and 69, respectively. The juncture point between elongated rod 61 and tension members 64 and 65 is respectively hinged so as to permit the arrangement to function hereinbelow.

With continued attention being directed to FIG. 3, the arrangement is such that upon the application of inwardly directed pressure sufficient for inward deflection of the wall panels, the angular relationship between the first and second elongated members 61 and 62 is altered so as to cause the angle at the apex 63 to increase, and force the cutter blade 70 disposed at the outer tip of rod 62 to perforate closure film 25, and thus permit emptying of the contents of the container 10.

It will be observed that various modifications may be made of the arrangements disclosed herein without departing from the spirit and scope of the present invention.

What is claimed is:

1. In combination with a container having a generally cylindrical configuration with a bottom wall, a circular spout-like top with a closure cap adapted to be threadably engaged about a planar annular seal surface therearound and with said container including flexible side panels with a front panel, rear panel and end panels depending from said top and joining with said bottom wall, a closure film forming a secondary seal with said planar annular seal surface and being adhesively bonded to the surface of said annular seal surface, and means disposed within said container for achieving perforation of said closure film forming said secondary seal upon innerdeflection of said flexible end panels:

(a) said seal film perforation means comprising first and second elongated rod members pivotally joined together at an apex in generally right angular relationship, one to the other;

(b) said first rod member having an anvil means coupled to the free tip thereof and with said anvil being normally disposed generally at the juncture between one of said end panels and the bottom closure wall;

(c) said second rod member having a cutter blade coupled to the free tip end thereof and with said cutter blade being normally disposed along the interior of said spout-like tip adjacent to the innersurface of said closure film;

(d) the arrangement being such that upon the application of inwardly directed pressure to said end panels sufficient for inward deflection thereof, the angular relationship between said first and second elongated rod at said apex increases to cause outward movement of said second rod member to force said cutter blade to move more outwardly of said spout and perforate said closure film.

2. In combination with a container having a generally cylindrical configuration with a bottom wall, a circular spout-like top with a closure cap adapted to be threadably engaged about a planar annular seal surface therearound and with said container including flexible side panels with a front panel, rear panel and end panels depending from said top and joining with such bottom walls, a closure film forming a secondary seal with said planar annular seal surface and being adhesively bonded to the surface of said annular seal surface, and means disposed within said container for achieving perforation of said closure film forming said secondary seal upon innerdeflection of said flexible end panels:

(a) said seal perforation means comprising elongated rod means arranged to be disposed within said container and having a length such that the said rod means is arranged in first and second segments at generally right angular relationship, one to the other;

(b) said elongated rod means having an anvil means coupled to one end thereof, and a cutter blade coupled to the opposed end thereof, said anvil being normally disposed generally at the juncture between the said end panels and the bottom closure wall, and with said cutter blade being normally disposed along the interior of such spout-like tip adjacent to the innersurface of said closure film;

(c) the arrangement being such that upon the application of inwardly drafted pressure to said end panels sufficient for inward deflection thereof, the angular relationship between the first and second segments of said elongated rod means causes outward movement of said elongated rod to force said cutter blade to more outwardly and through said spout so as to perforate such closure film.

* * * * *

UNITED STATES PATENT AND TRADEMARK OFFICE

CERTIFICATE OF CORRECTION

PATENT NO. : 4,953,706

DATED : September 4, 1990

INVENTOR(S) : Don Piccard

It is certified that error appears in the above-identified patent and that said Letters Patent is hereby corrected as shown below:

Column 6, line 39, "drafted" should read -- directed --.
Line 44, "more" should read -- move --.

Signed and Sealed this

Thirty-first Day of March, 1992

*Attest:*

HARRY F. MANBECK, JR.

*Attesting Officer*

*Commissioner of Patents and Trademarks*